US008136694B1

(12) United States Patent
Vieau et al.

(10) Patent No.: US 8,136,694 B1
(45) Date of Patent: Mar. 20, 2012

(54) CUP WITH IMPROVED CHARACTERISTICS

(76) Inventors: Mark L. Vieau, Green Bay, WI (US); Charles A. Martin, Franklin, PA (US)

( * ) Notice: Subject to any disclaimer, the term of this patent is extended or adjusted under 35 U.S.C. 154(b) by 581 days.

(21) Appl. No.: 12/275,184

(22) Filed: Nov. 20, 2008

Related U.S. Application Data

(60) Provisional application No. 61/003,756, filed on Nov. 20, 2007.

(51) Int. Cl.
*B65D 1/40* (2006.01)
*B65D 25/28* (2006.01)
*B65B 53/00* (2006.01)

(52) U.S. Cl. ..... 220/735; 220/756; 53/441

(58) Field of Classification Search ..... 53/441; 16/111.1; D9/717, 716, 715
See application file for complete search history.

(56) References Cited

U.S. PATENT DOCUMENTS

| | | | | | |
|---|---|---|---|---|---|
| 390,089 | A | * | 9/1888 | McClelland | 222/80 |
| 617,952 | A | * | 1/1899 | Burton | 116/308 |
| 1,271,405 | A | * | 7/1918 | Wilt | 220/86.1 |
| 1,276,018 | A | * | 8/1918 | Blaetus | 220/735 |
| 1,364,194 | A | * | 1/1921 | Groehn | 220/756 |
| 2,613,517 | A | * | 10/1952 | Frantz | 220/23.2 |
| 2,745,586 | A | * | 5/1956 | Thoma | 229/401 |
| 2,867,365 | A | * | 1/1959 | La Tourette, Jr | 229/401 |
| 3,202,275 | A | * | 8/1965 | Loughary | 206/127 |
| D216,407 | S | * | 12/1969 | Kull et al. | D7/608 |
| D282,615 | S | * | 2/1986 | Levine | D7/513 |
| D283,385 | S | * | 4/1986 | Mansueto | D7/513 |
| D295,009 | S | * | 4/1988 | Mansueto | D7/513 |
| D309,401 | S | * | 7/1990 | Lombardi | D7/507 |
| 5,163,561 | A | * | 11/1992 | Fitzgerald | 206/581 |
| D337,920 | S | * | 8/1993 | Rowe | D7/507 |
| 5,482,095 | A | * | 1/1996 | de Chollet | 141/380 |
| 5,806,704 | A | * | 9/1998 | Jamison | 220/212 |
| 5,941,411 | A | * | 8/1999 | Langenbach | 220/735 |
| 5,992,678 | A | * | 11/1999 | Willey | 220/735 |
| 6,092,647 | A | * | 7/2000 | Yeh et al. | 206/86 |
| D443,477 | S | * | 6/2001 | Miura | D7/507 |
| 6,688,469 | B1 | * | 2/2004 | Barnes | 206/541 |

* cited by examiner

*Primary Examiner* — Mickey Yu
*Assistant Examiner* — Robert J Hicks
(74) *Attorney, Agent, or Firm* — Brannen Law Office, LLC

(57) ABSTRACT

The cup of the present invention can have a body made of a foam material. The cup has a handle and a holder. The handle and the holder can each have a flange, respectively, to secure to the cup. The flanges, respectively, are shaped to mate with the external periphery of the cup, and can be initially held in place with an adhesive. A shrinkable wrap can then be positioned around the cup. Upon a heat treatment, the wrap shrinks to tightly engage the outside of the cup. Further, the shrink wrap maintains secure engagement between the flanges and the cup so that the handle and holder are secure. A cover can be provided for covering the cup. A package can be secured within a cavity on the top of the cover. The package can contain a fluid enabling the cup to be used for portable meals.

16 Claims, 9 Drawing Sheets

CUP WITH IMPROVED CHARACTERISTICS

This U.S. utility patent application claims priority on and the benefit of provisional application 61/003,756 filed by the same inventors on Nov. 20, 2007, the entire contents of which are hereby incorporated herein by reference.

BACKGROUND OF THE INVENTION

1. Field of the Invention

The present invention relates to a cup having a handle and a utensil holder secured with shrink wrap.

2. Description of the Related Art

Cups have been used in most cultures throughout history. The history of cups is too voluminous to dictate here. Yet, it is sufficient to state that there is still room for improvement and innovation within the modern cup industry. In particular, there is room for improvement and innovation in the disposable cup industry.

There are many cups made of Styrofoam brand foam material and the like. This material is useful for its intended insulative purpose. Yet, the cups of foam materials do not typically have handles or the like. This lack of a handle can pose problems for transporting the cup.

Other disposable cups can be made of treated paper products, such as waxed paper. Again, while these products may work well for their intended purposes, there are some limitations associated with their use. There are typically no handles with paper cup products. Further, the paper products are relatively easily damaged or crushed. While being easily crushed may be a desirable quality upon disposal, it is not desirable when transporting a hot beverage. A further problem is that the paper products generally lack thermal insulation. For this reason, paper cup type products, when used alone, are not typically useful with hot beverages.

Sleeves have been developed for use with paper and other types of cup products. The sleeve has a nominal thickness, and can provide thermal insulation. The sleeve typically slides up from the bottom of the cup until the external perimeter of the cup is equal to the interior perimeter of the sleeve, at which point the sleeve and cup engage each other. While the sleeves work well, there use can be less than optimal. For example, the sleeves typically rely of friction between the sleeve and cup to maintain engagement with the cup.

A further problem with existing disposable cups is that they typically do not accommodate a utensil. This is disadvantageous in a retail or commercial setting, as the customer or user may need to stir the beverage or otherwise use a utensil with the product within the cup.

A still further drawback yet is that advertising or labeling is typically printed on the exterior surface of the cup. Such exterior labeling often looks great initially. Yet, the exterior can be scratched or otherwise damaged during shipment and storage. Further, during use, the beverage can contact the printing and cause the printing to rub or run off or otherwise delaminate from the exterior of the cup.

A still further drawback yet with existing products is that the existing products do not accommodate use of a secondary package (such as an aseptic container with milk) mated with the cover to make a fully disposable meal such as cereal with milk.

Thus there exists a need for a shrink wrap cup that solves these and other problems.

SUMMARY OF THE INVENTION

The present invention relates to a cup having a handle and a utensil holder secured with shrink wrap. The cup can have a body made of a foam material. In one embodiment, the cup has a handle and a holder. The handle and the holder can each have a flange, respectively, to secure to the cup. The flanges, respectively, are shaped to mate with the external periphery of the cup, and can be initially held in place with an adhesive. A shrinkable wrap can then be positioned around the cup. Upon a heat treatment, the wrap shrinks to tightly engage the outside of the cup. Further, the shrink wrap maintains secure engagement between the flanges and the cup so that the handle and holder are secure. A cover can be provided for covering the cup. A package can be secured within a cavity on the top of the cover. The package can contain a fluid enabling the cup to be used for portable meals.

According to one advantage of the present invention, the body of the cup can be made of a lightweight material. One preferred material is Styrofoam brand foam material.

According to another advantage of the present invention, a handle is provided for gripping. The handle is securely held in place relative the foam body.

According to a further advantage of the present invention, a holder is provided. The holder can hold a utensil such as a spoon.

According to a still further advantage of the present invention, a wrap is provided. The wrap is a heat activated shrink wrap. The wrap serves several advantageous functions. First, the wrap snuggly engages the external surface of the cup to provide structural support. Second, the wrap securely holds the holder and handle in place on the outside of the cup. In this regard, the wrap overcomes one problem associated with using a handle in a foam cup, namely, that the foam is weak, and will not accommodate the use of a handle.

According to a further advantage of the wrap, advertising can be placed in the inside of the wrap. In this regard, the ink will be protected during shipping, storage and use. Further, the wrap can be pre-printed, such that the desired printing will be apparent after the wrap has shrunk to place and tightened around the outside of the cup.

According to a still further advantage yet of the present invention, a cover can be provided having a cavity in the top of the cover. A package can be snuggly received within the cavity. The package can hold a fluid, such as milk, so that the cup can be used for cereal with milk.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
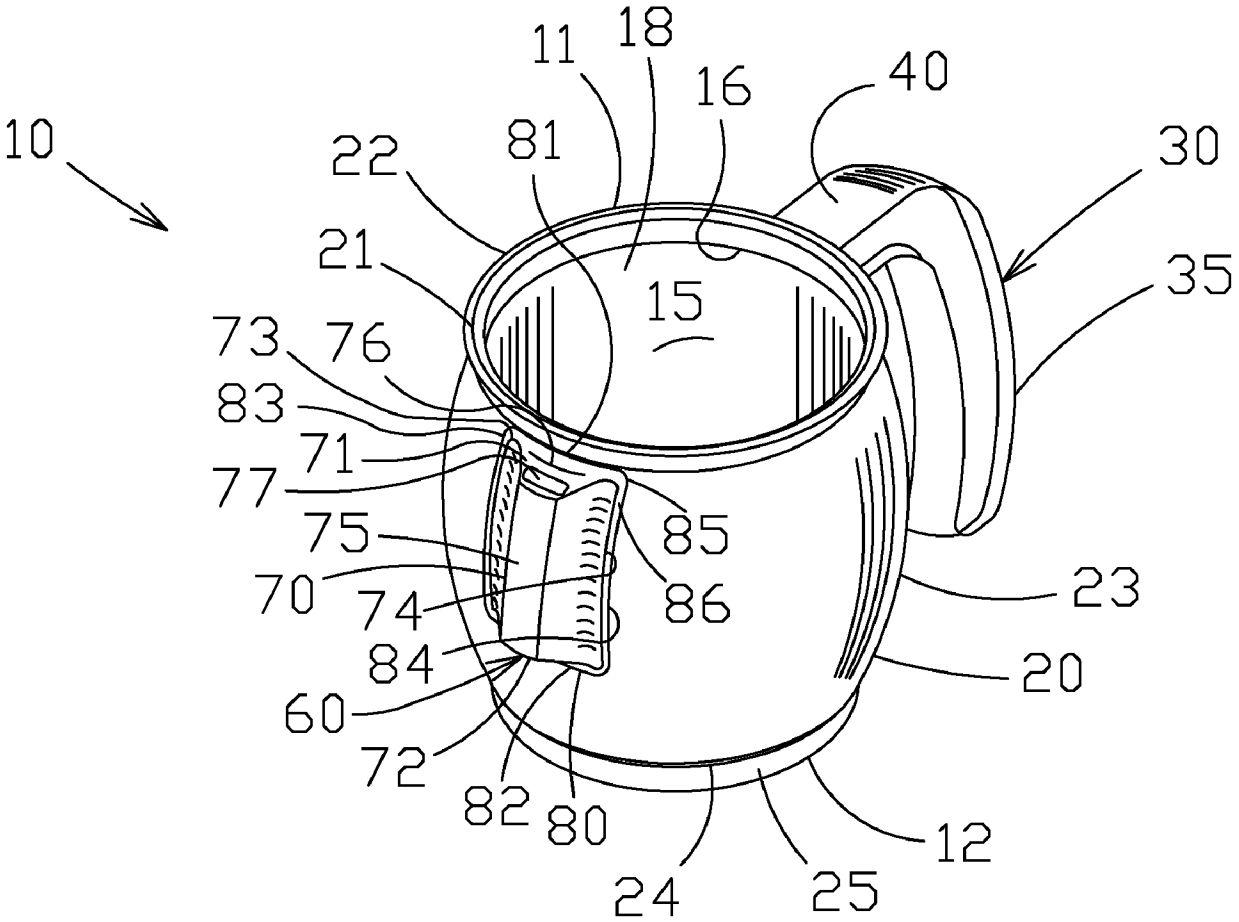
FIG. 1 is a perspective view of a preferred embodiment of the present invention.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

According to one embodiment of the present invention, and looking at FIGS. 1-5, it is seen that a cup 10 is provided. The cup 10 has a top 11 and a base 12. The cup 10 further has an inside 15 and an outside 20. The cup 10 can be made from a foam material. One material is Styrofoam brand foam material. Yet, it is understood that other materials can be utilized without departing from the broad aspects of the present invention. The cup 10 can be molded in a cavity tooling and ejected from the tooling upside down. The cup can have a 12 or 16 ounce capacity in the preferred embodiment. Yet, it is appreciated that the capacity can be greater or smaller without departing from the broad aspects of the present invention.

The inside 15 has a top 16, a bottom 17 and a wall 18. The wall preferably defines a generally conical shaped interior. Accordingly, the wall 18 is preferably tapered, such that the top has a diameter that is larger than the diameter of the wall at the bottom 17 of the inside 15.

Figure 5:
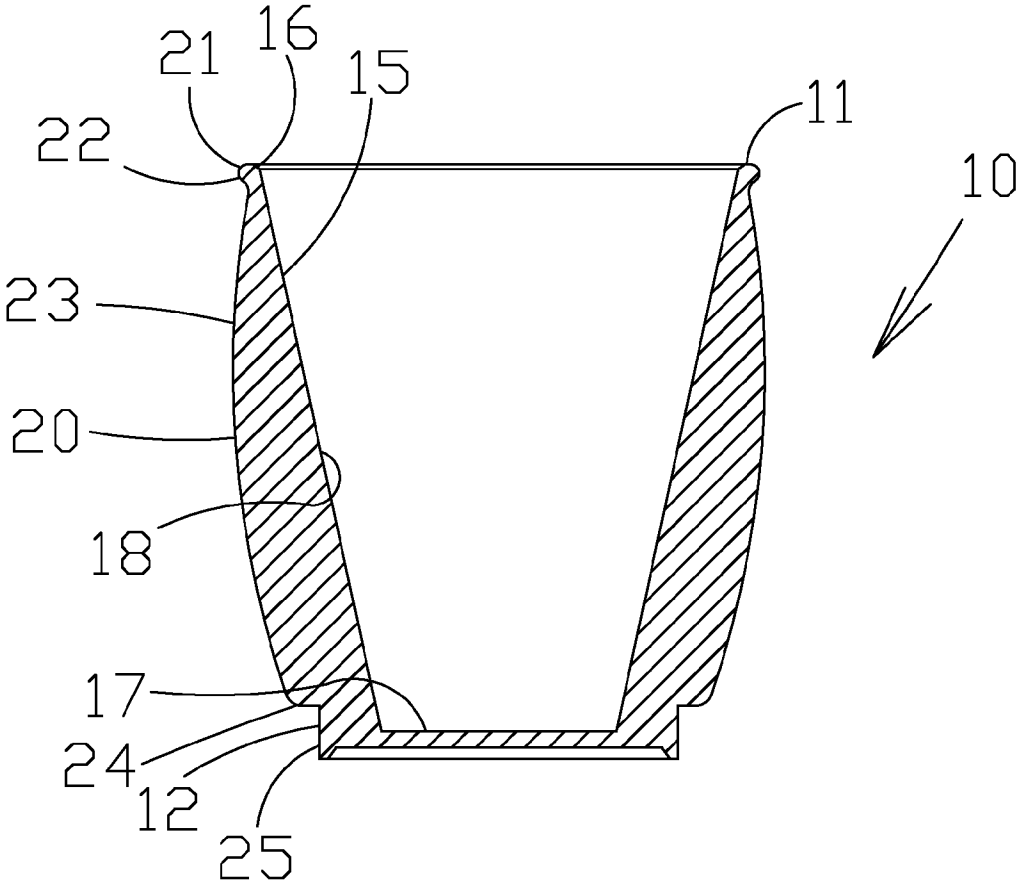
FIG. 5 is a cross-sectional view taken along line A-A in FIG. 3.

The outside 20 also has a top 21. A lip 22 encircles the top 21 of the outside 20 of the cup 10. A wall 23 is provided between the top 21 and a bottom 24. The wall preferably has a barrel shaped outer periphery. In this regard, the diameter of the external wall 23 is smaller at the top 21 and the bottom 24 than it is at the middle of the wall intermediate between the top and the bottom. A cuff 25 is at the bottom 24 of the cup, as best shown in FIG. 5. The cuff 25 is used to engage a surface and space the bottom of the cup from that surface a predetermined amount.

Figure 2:
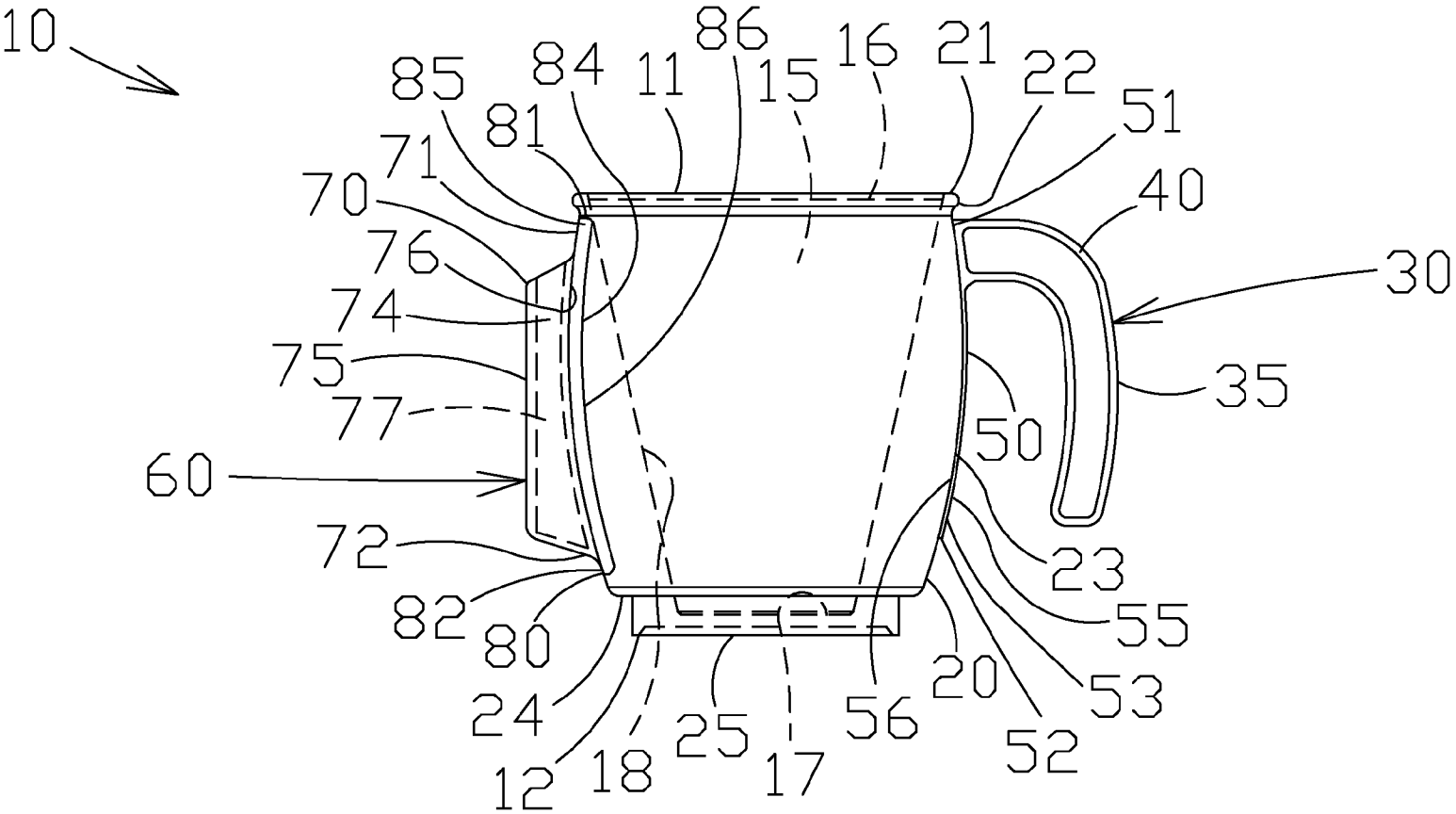
FIG. 2 is a side view of the preferred embodiment shown in FIG. 1.
Figure 3:
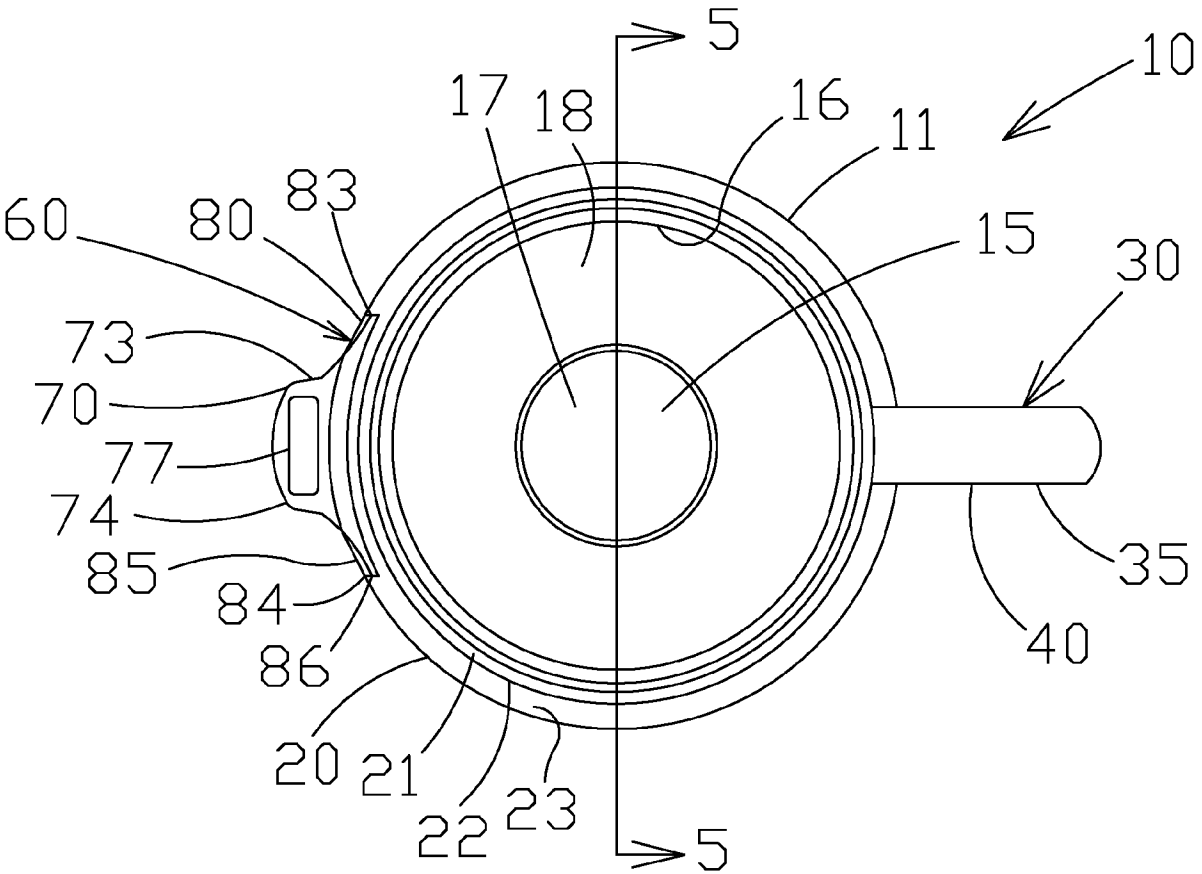
FIG. 3 is a top view of the preferred embodiment shown in FIG. 1.
Figure 4:
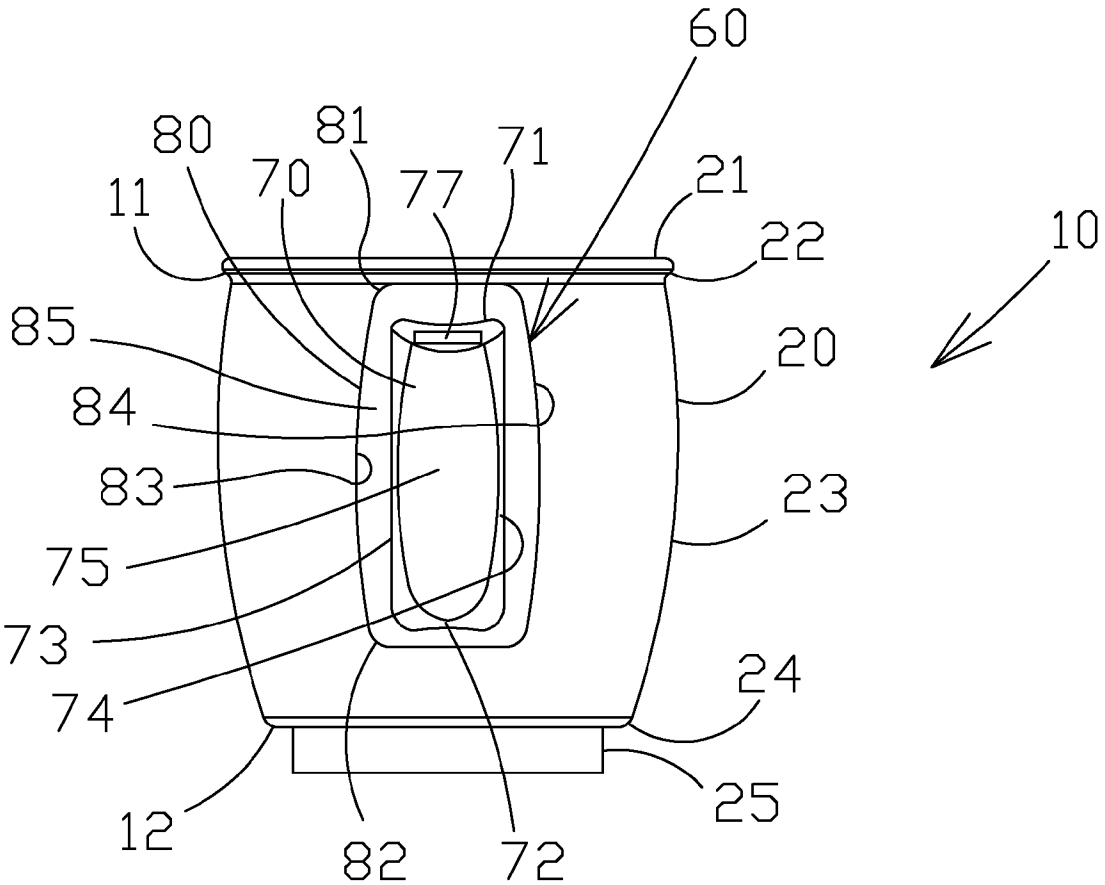
FIG. 4 is a side view of the preferred embodiment shown in FIG. 1

Keeping with FIGS. 1-3, a handle 30 is provided. The handle has a vertical arm 35 and a horizontal arm 40. The vertical arm 35 preferably has a generally I-shaped profile. Yet, it is understood that other profiles can be used without departing from the broad aspects of the present invention. The vertical arm 35 has a top and a bottom. The horizontal arm 40 has a first end and a second end. The top of the vertical arm 35 is preferably integral with the second end of the horizontal arm 40. The horizontal arm 40 preferably has a generally I-shaped profile. Yet, it is understood that other profiles can be used without departing from the broad aspects of the present invention.

A flange 50 is also provided. The flange 50 has a top 51 and an opposed bottom 52, a first edge 53 and an opposed second edge 54, and a free side 55 and a second side 56. The second end of the horizontal arm 40 can be integral or connected to the flange upon side 55. The integration or connection is preferably located near or at the top 51 of the flange 50. Side 56 is preferably shaped to mate with the wall 23 on the outside 20 of the cup. The side 56 can have a concave shape to mate with the generally barrel shaped outside 20 of the cup 10. An adhesive can be provided for making an initial connection between the flange 50 and the cup 10.

Now looking at FIGS. 1-4, a holder 60 is provided. The holder 60 has a body 70 having a top 71 and a bottom 72, a first edge 73 and an opposed second edge 74, and a first side 75 and a second side 76. A hole 77 extends through the body 70, and is open to the top 71 and optionally to the bottom 72 as well. A spoon or other utensil can be removably received within hole 77 of the body 70.

A flange 80 is also provided. The flange 80 has a top 81 and an opposed bottom 82, a first edge 83 and an opposed second edge 84, and a free side 85 and a second side 86. Side 76 of the body can be integral or connected to the flange upon side 85. Side 86 is preferably shaped to mate with the wall 23 on the outside 20 of the cup. An adhesive can be provided for making an initial connection between the flange 80 and the cup 10.

Figure 7:
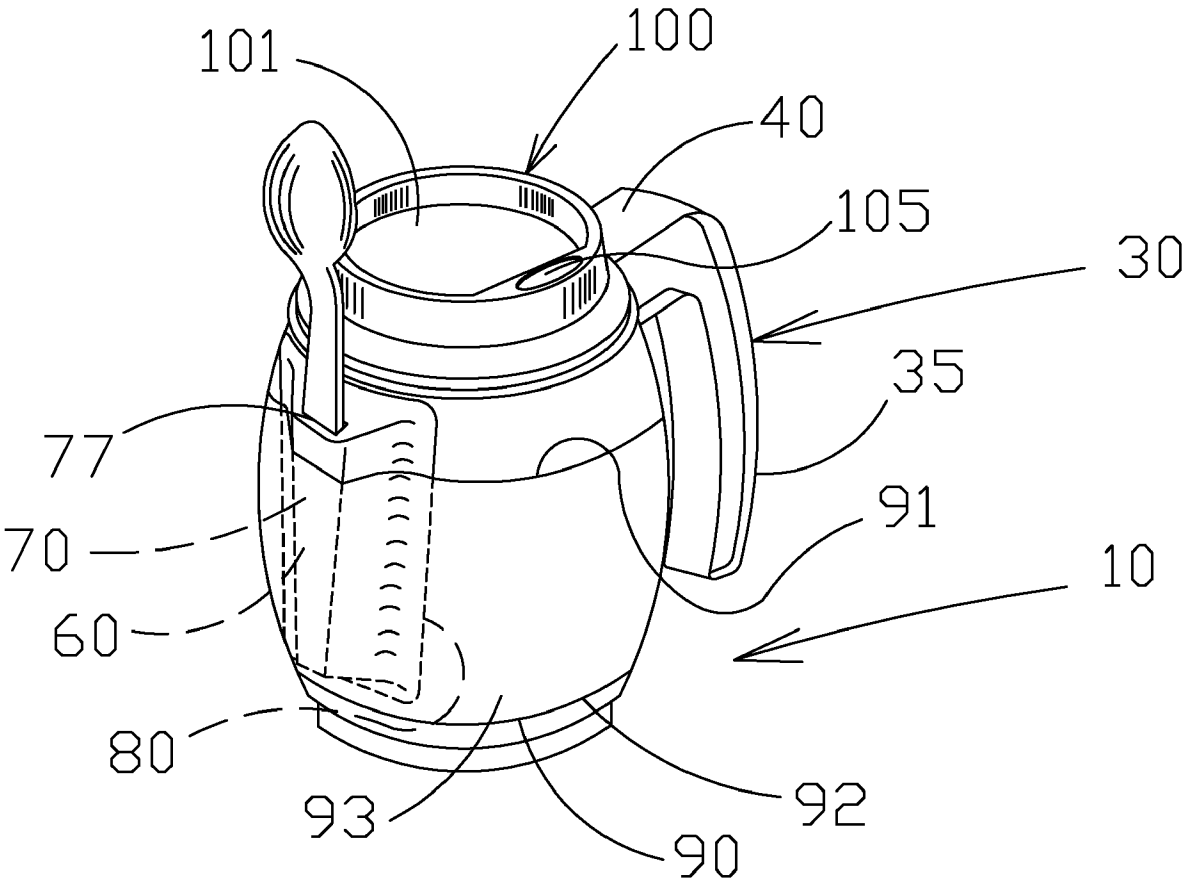
FIG. 7 is a perspective view of the embodiment shown in FIG. 6 shown for use with a container.
Figure 9:
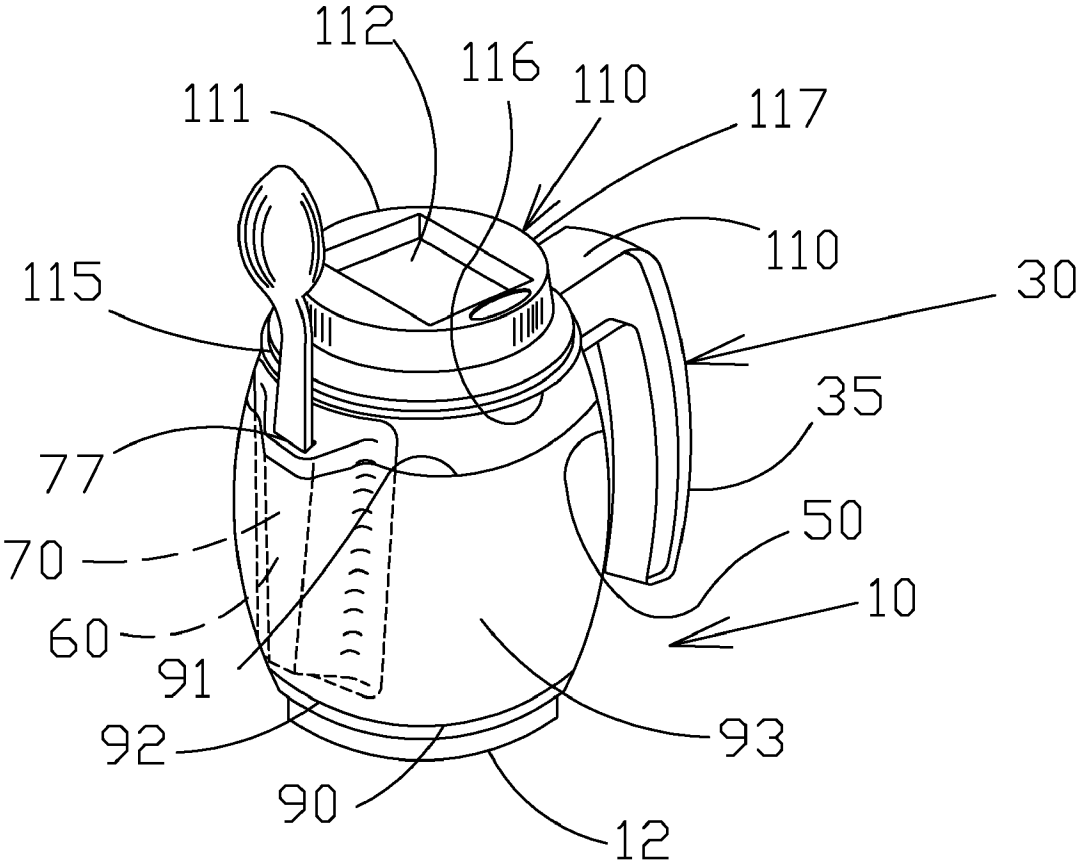
FIG. 9 is a perspective view of the embodiment shown in FIG. 8 shown for use with a container.

Looking now to FIGS. 7 and 9, it is shown that a wrap 90 is provided. The wrap 90 has a top 91 and an opposed bottom 92. The wrap 90 also has an outside surface 93 and an opposed inside surface (not shown). The wrap 90 can be a plastic wrap that shrinks in response to being subject to heat or another environmental factor. The wrap 90 can be slid over the cup 10 after the handle 30 and holder 60 are initially positioned with adhesive. The environmental factor, such as heat, can then be applied to cause the wrap to shrink and snuggly secure the handle and the holder in place upon the outside of the cup 10. The heat can preferably be applied in heat tunnel, where the wrap is shrunk over time as a conveyer passes through the tunnel. It is appreciated that the dimensions of the outside 20 of the cup 10 prohibit the handle 30 and holder 60 from slipping during use. This is because the wrap 90 securely holds the handle 30 and holder 60 in place against the outside of the cup 10.

It is appreciated that the wrap is clear or at least partially see thru or transparent. In this regard, an image such as an advertisement or label can be applied to the inside of the wrap 90 prior to slipping the wrap 90 over the outside of the cup 10. The advertisement can be designed so that it is in proper size and dimension after the wrap 90 is shrunk. It is appreciated that the cup 10, the handle 30, the holder 60 and the wrap are microwavable.

Figure 6:
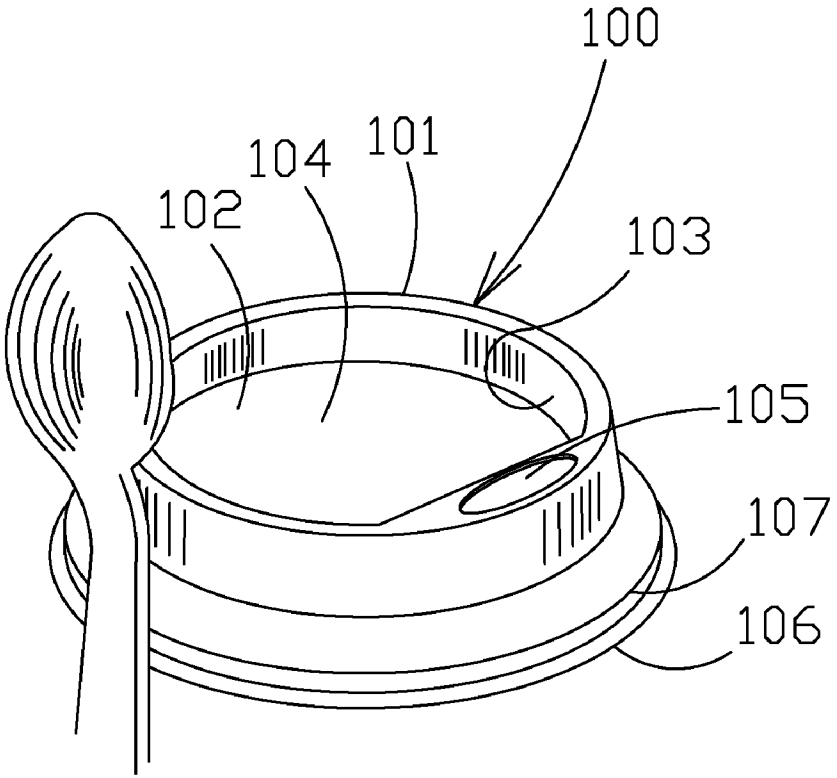
FIG. 6 is a perspective view of a preferred embodiment of a cover.

Looking now to FIGS. 6 and 7, a first preferred cover 100 is illustrated. The cover 100 has a top 101 and a bottom 106. A cavity 102 is formed into the top 101 of the cover 100. The cavity is defined by a sidewall 103 having a perimeter that is polygonal in shape, and by a floor 104. The cavity 102 is designed to snugly receive a package. One package can be an aseptic package for storing milk or another beverage. The package or container can preferably hold six or eight ounces of fluid. A hole 105 is through the top 101 of the cover 100 to allow a person to sip a beverage that is contained within the cup 10. The bottom 106 has a lip 107 that engages the lip 22 on the top 21 of the outside 20 of the cup 10 to secure the cover 100 in place. It is appreciated that a secondary wrap can be used to secure the package within the cavity 102 during shipping and storage.

Figure 8:
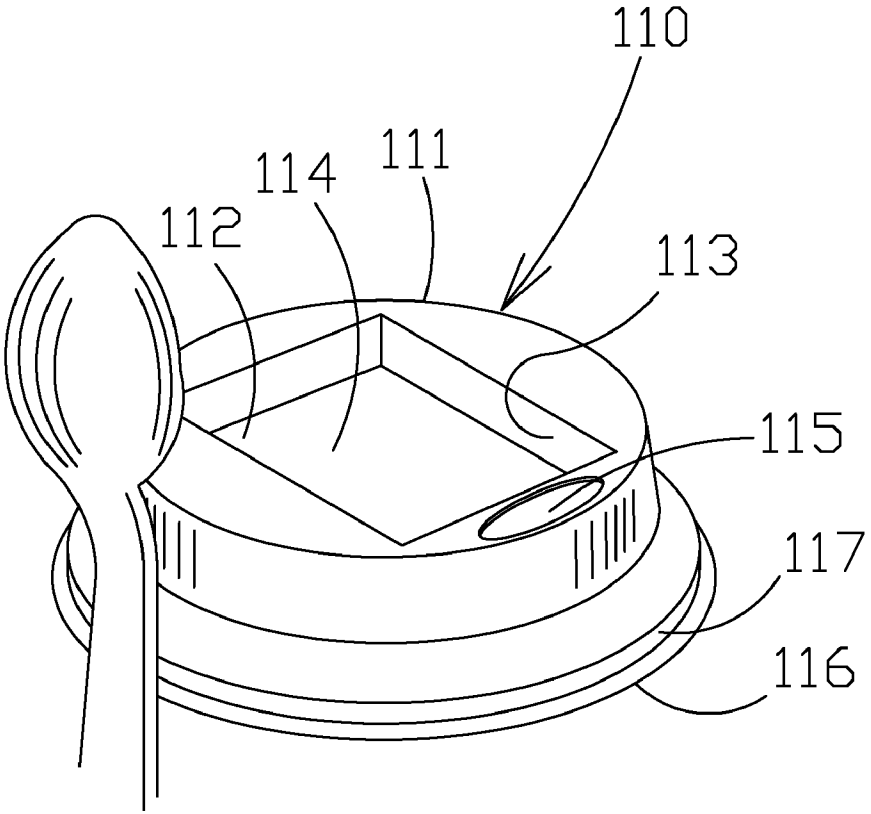
FIG. 8 is a perspective view of an alternative preferred embodiment of a cover.

Looking now to FIGS. 8 and 9, an alternative preferred cover 110 is illustrated. The cover 110 has a top 111 and a bottom 116. A cavity 112 is formed into the top 111 of the cover 110. The cavity is defined by a sidewall 113 having a perimeter that is square or rectangular in shape, and by a floor 114. The cavity 112 is designed to snugly receive a package. One package can be an aseptic package for storing milk or another beverage. A hole 115 is through the top 111 of the cover 110 to allow a person to sip a beverage that is contained within the cup 10. The bottom 116 has a lip 117 that engages the lip 22 on the top 21 of the outside 20 of the cup 10 to secure the cover 110 in place. It is appreciated that a secondary wrap can be used to secure the package within the cavity 112 during shipping and storage.

It is appreciated that while two preferred perimeters are shown in FIGS. 6-9, other cavity shapes can be utilized without departing from the broad aspects of the present invention. For example, the cavities can be round.

Thus it is apparent that there has been provided, in accordance with the invention, a shrink wrap cup that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A combination comprising:

a cup having an inside and an outside, said outside having a wall with a wall top with a wall top diameter, a wall middle with a wall middle diameter and a wall bottom with a wall bottom diameter, said wall top diameter and said wall bottom diameter being smaller than said wall middle diameter;

a handle having a flange; and a wrap that shrinks in response to a predetermined environmental condition, whereby said wrap holds said flange of said handle against said outside of said cup and said wrap shrinks to said wall top diameter, said wall middle diameter and said wall bottom diameter, whereby said wrap is prevented from shifting due to said wall top diameter and said wall bottom diameter being smaller than said wall middle diameter.

2. The combination of claim 1 wherein said environmental condition is exposure to heat.

3. The combination of claim 1 wherein said flange has a flange inside that is shaped to mate with said outside of said cup.

4. The combination of claim 3 wherein:

said outside of said cup is generally barrel shaped; and said flange inside is generally concave, whereby when said wrap holds said flange of said handle against said outside of said cup, said flange is vertically supported.

5. The combination of claim 1 further comprising a holder for supporting a utensil.

6. The combination of claim 5 wherein said holder and said handle are generally on opposite sides of said outside of said cup.

7. The combination of claim 5 wherein said holder has a holder inside that is shaped to mate with said outside of said cup.

8. The combination of claim 5 wherein said holder has a vertical hole to receive a handle of the supported utensil.

9. The combination of claim 1 wherein said wrap has a wrap inside and a wrap outside, said wrap being at least partially see thru and being preprinted on said wrap inside with a desired image observable from said wrap outside when said wrap shrinks to said cup.

10. The combination of claim 1 further comprising a cover shaped to mate with said combination.

11. The combination of claim 1 wherein said cup comprises foam.

12. A combination comprising:

a cup having an inside and an outside, said outside having a wall with a wall top with a wall top diameter, a wall middle with a wall middle diameter and a wall bottom with a wall bottom diameter, said wall top diameter and said wall bottom diameter being smaller than said wall middle diameter;

a handle having a flange mated to said outside of said cup;

a holder having a holder inside mated to said outside of said cup, said holder comprising a vertical hole receiving a portion of a utensil; and a wrap that shrinks in response to a predetermined environmental condition, whereby said wrap holds said flange of said handle against said outside of said cup and said wrap shrinks to said wall top diameter, said wall middle diameter and said wall bottom diameter, whereby said wrap is prevented from shifting due to said wall top diameter and said wall bottom diameter being smaller than said wall middle diameter.

13. The combination of claim 12 further wherein said wrap shrinks in response to a predetermined environmental condition, whereby said wrap holds said flange of said handle and said holder inside against said outside of said cup.

14. The combination of claim 13 wherein said predetermined environmental condition is heat.

15. The combination of claim 13 wherein said wrap has a wrap inside and a wrap outside, said wrap being at least partially see thru and being preprinted on said wrap inside with a desired image observable from said wrap outside when said wrap shrinks to said cup.

16. The combination of claim 12 wherein said outside of said cup is generally barrel shaped.

* * * * *